United States Patent [19]

Wilson

[11] 4,050,046

[45] Sept. 20, 1977

[54] THERMOSTATIC SWITCH

[75] Inventor: Chester K. Wilson, Decatur, Ala.

[73] Assignee: Cutler-Hammer, Inc., Milwaukee, Wis.

[21] Appl. No.: 687,892

[22] Filed: May 19, 1976

[51] Int. Cl.[2] ..... H01H 37/40

[52] U.S. Cl. ..... 337/319; 200/67 D; 337/323

[58] Field of Search ..... 337/312, 316, 319, 320, 337/323, 327, 330; 200/67 D

[56] References Cited

U.S. PATENT DOCUMENTS

| | | | |
|---|---|---|---|
| 2,784,272 | 3/1957 | Carter | 337/320 |
| 2,821,588 | 1/1958 | Fisher | 200/67 D |

FOREIGN PATENT DOCUMENTS

| | | | |
|---|---|---|---|
| 2,447,400 | 4/1975 | Germany | 337/320 |

*Primary Examiner*—William H. Beha, Jr.
*Attorney, Agent, or Firm*—Hugh R. Rather; William A. Autio; Michael E. Taken

[57] ABSTRACT

An improved thermostatic switch which employs a pressure linear thermal power element and a simplified diaphragm motion translating and amplifying means while dispensing with need for diaphragm loading spring. It features a one piece motion transmitting lever between the diaphragm and electric switch operator, and an improved snap-action switch operating mechanism. A one-piece molded insulating housing, and an improved knob coupling member on the temperature range adjusting shaft are employed.

5 Claims, 8 Drawing Figures

Fig. 1
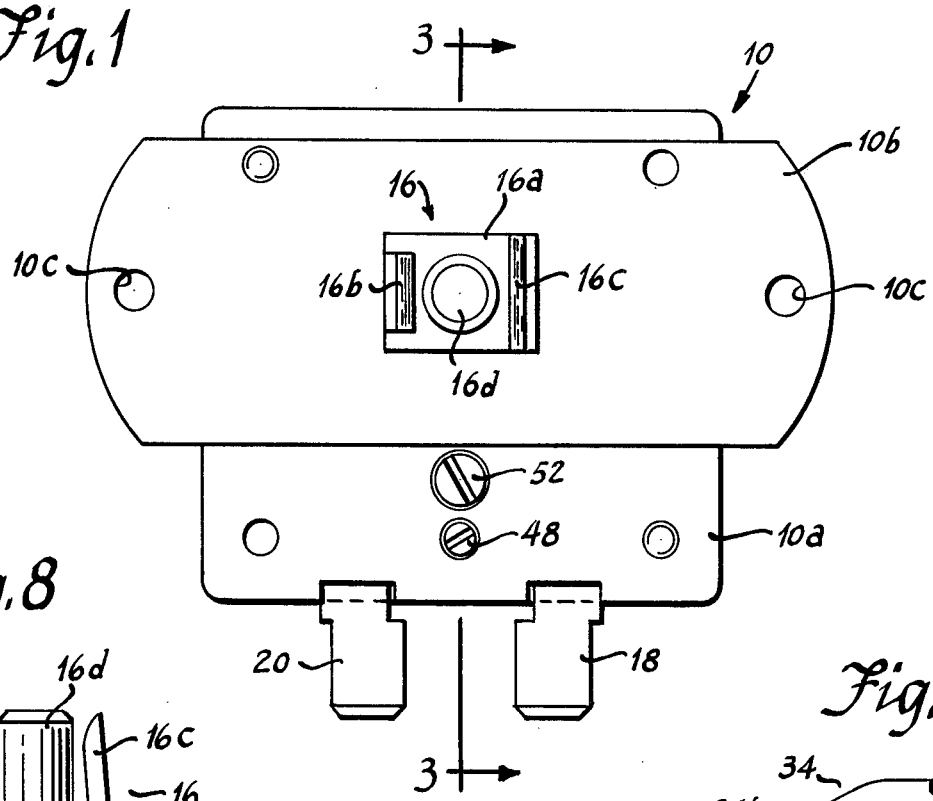
Fig. 8
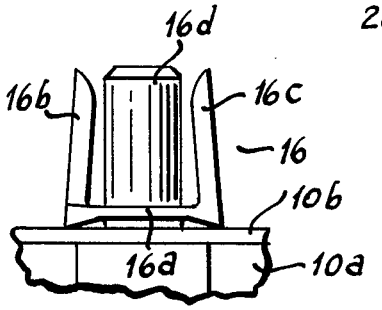
Fig. 7
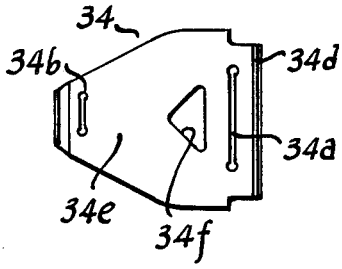
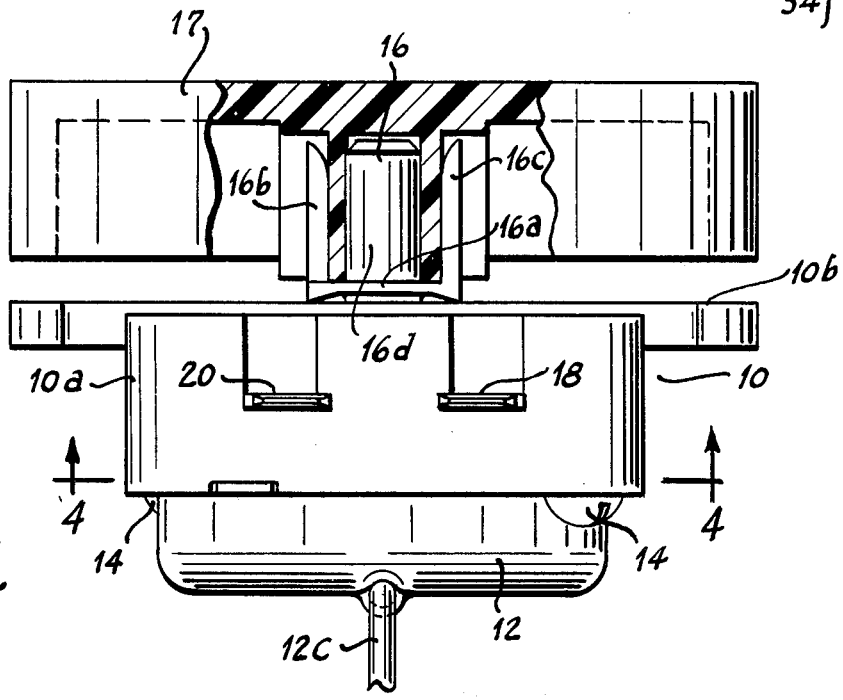
Fig. 2

THERMOSTATIC SWITCH

BACKGROUND OF THE INVENTION

The Kuhn et al. U.S. Pat. No. 3,135,849 discloses and claims theremostatic switches which have gained wide acceptance for controlling the temperatures in electric refrignerators, freezers, unit room air conditioners and the like. Those thermostatic switches are characterized by using gas or vapor filled thermal power element in which the movement of the diaphragms bears a linear relationship to changes in pressure within the diaphragm chamber. Additionally these switches are characterized by employing a diaphragm motion transmitting and amplifying mechanism that avoids need for use of customary diaphragm loading springs. While these thermostatic switches have proved to be eminently successful in a wide variety of refrigeration control applications, today's increased costs of materials and labor makes desirable improvements in their design, particularly as to numbers and simplification of parts and their cost of manufacture.

OBJECTS OF THE INVENTION

It is a primary object of the present invention to provide a thermostatic switch of the aforementioned type which is improved and simplified as to the number of parts and their cost of manufacture.

A more specific object of the invention is to provide a simplified diaphragm motion transmitting and amplifying mechanism.

Another specific object is to provide a one-piece insulating housing which avoids need for additional enclosure parts for the switch or separate insulator parts for electrical current carrying parts.

A still further specific object is to provide an improved universal type friction coupling member between the range adjusting shaft and its control knob.

Other objects and advantages of the invention will hereinafter appear.

BRIEF DESCRIPTION OF THE DRAWINGS

FIG. 1 is a top plan view of the thermostatic switch constructed in accordance with the pesent invention.

FIG. 2 is a view in side elevation of the switch.

FIG. 7 is a plan view of a flat spring member used in the switch, and

FIG. 8 is a fragmentary view of a knob coupling member used in the switch.

THE PREFERRED EMBODIMENT

Figure 3:
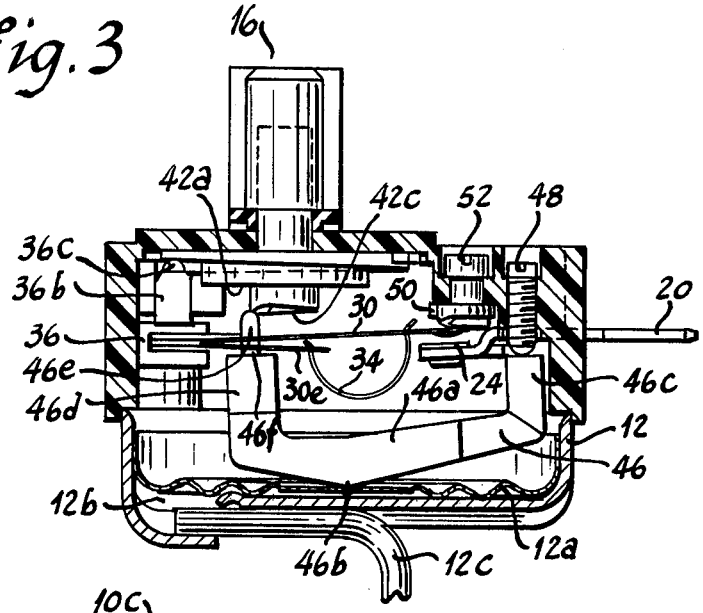
FIG. 3 is a view in vertical cross section taken along the line 3—3 of FIG. 1.

The thermostatic switch of the present invention comprises a one-piece molded insulating base 10, a vapor filled power element 12 which is secured to an end of base 10 by two screws 14 disposed at diagonally opposite corners of the square body portion 10a of base 10, a range adjusting shaft 16, and a pair of electric line terminals 18 and 20. The base 10 also has a integrally formed upper mounting flange 10b which has mounting holes 10c adjacent opposite convexlly curved ends thereof.

The power element 12 is of the thermal vapor type, which in a preferred form is like that disclosed and claimed in the Smith U.S. Pat. No. 2,751,935. As disclosed in that patent the diaphragm 12*a* is designed so that it moves upwardly and downwardly as viewed in FIG. 3 in a linear relation to changes in pressure of the thermal vapor or gas in the chamber **12*b* and tube 12*c***.

Figure 4:
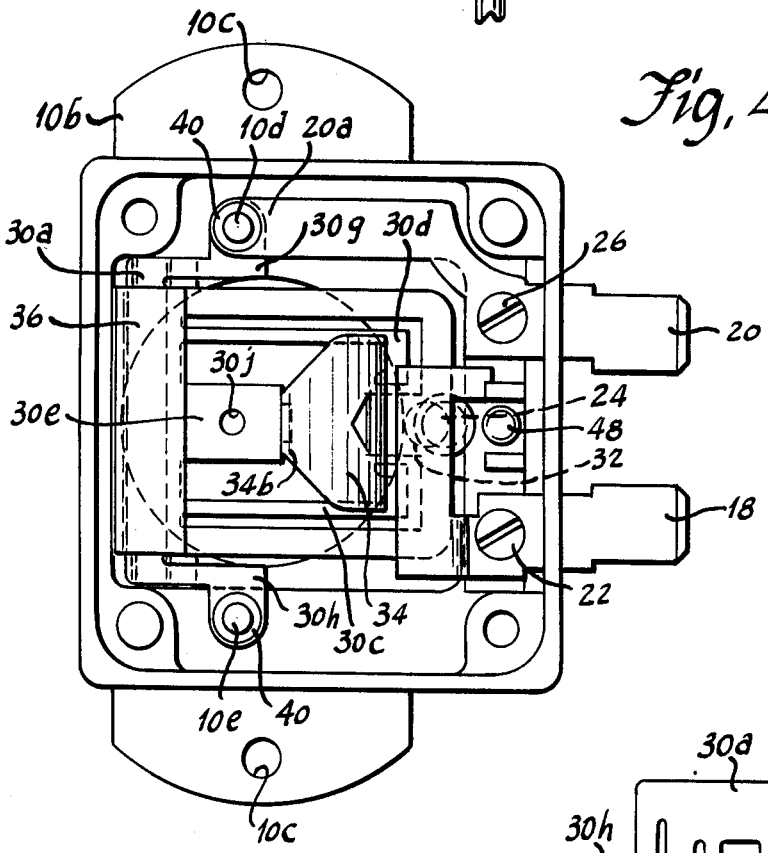
FIG. 4 is a view in horizontal cross section taken along the line 4—4 of FIG. 2.
Figure 5:
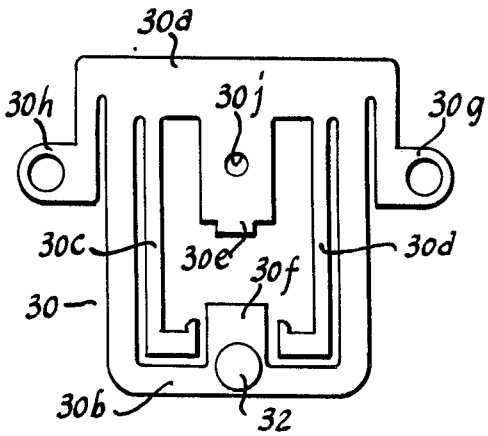
FIG. 5 is a view showing the detail of a movable reed contact member used in the switch depicted in FIGS. 1 to 4.

As best shown in FIG. 4, terminal 18 is secured interiorally of the portion **10*a* of base 10 by a screw 22 and has an electrical contact 24 formed of a good electrical conducting material secured thereon. Terminal 20 is also secured interiorally of the portion 10*a* of base 10 by a screw 26, and the depending leg portion 20*a* of that terminal has an opening adjacent its end which fits about a boss 10*d* formed in base 10**.

A reed member 30, which is preferably formed of beryllium copper material, has a base portion **30*a*, a U-shaped portion 30*b*, flipper arms 30*c* and 30*d*, an actuator arm portion 30*e*, and a shorter arm portion 30*f* and mounting legs 30*g* and 30*h*. Member 30 and all of its potions are integrally formed. An electrical contact 32 of good electrical conducting material is secured to member 30 where the bight of the portion 30*b* merges with the portion 30*f***.

The flipper arms **30*c* and 30*d* have inwardly turned tips which serve as pivot bearings for a C-shaped snap spring 34, which is provided with an elongated slot 34*a* into which also projects the portion 30*f* of member 30. The actuator arm 30*e* of member 30 has a reduced end portion which extends to a complementally formed slot 34*b* of spring 34 to provide a bearing for the opposite end of the latter. The preferred flat form of spring member obtained after stamping is that shown in FIG. 7. At the wider end 34*d* the corners of member 34 are notched to accommodate the hook shaped ends of the flipper arms 30*c* and 30*d* of member 30. The end portion 34*d* merges with a trapezoidal portion 34*e* and the slot 34*b* is formed adjacent the end of the latter. A triangular opening 34*f* is formed in member 34** serves to distribute the forces in the spring due to the different widths of the latter.

As will be apparent the C-shape of member 34 is imparted by its bearing mountings on the flipper arms **30*c* and 30*d*, and actuator arm 30*e* of reed member 30. This mounting places the flipper arms in tension and the portion 30*e* in compression. However, the U-shaped portion 30*b* is not subjected to longitudinal or transverse stresses. Consequently it will move upwardly and downwardly as its extension 30*f* is engaged by the bottom or top margins of the slot 34*a* of spring 34. It will be apparent to those skilled in the art that the flipper arms 30*c* and 30*d* will move with snap action as actuator arm 30*e* is moved in one direction or the other perpendicularly of the normal plane of member 30**.

The base portion **30*a* of reed member 30 is clamped in a longitudinal slot 36*a* formed in the transversely extending rectangular portion 36*b* of a cam follower 36. Cam follower 36, which is preferably formed from a suitable molded insulating material, is provided with an integral generally cylindrical stem portion 36*b* which has a substantially hemispherical end 36*c*** formed thereon.

The mounting leg **30*g* of member 30 has an opening thereon which aligns with a similar opening in the leg portion 20*a* of terminal 20 and seats therewith around the boss 10*d* in base 10. A spring washer 40 which fits over boss 10***d* with a force fit secures the mounting leg 30*g* and the depending leg 20*a* of terminal 20 in good electrical conducting relation on the base 10. The other mounting leg 30*h* of member 30 is similarly provided with an opening which fits about a boss 10*e* in base 10 and is secured to the base at that point by a spring washer 40 which is secured to the boss 10*e.*

Figure 6:
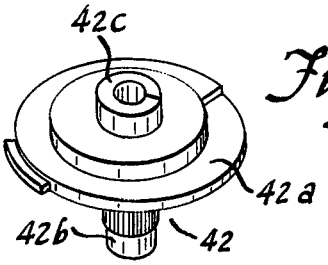
FIG. 6 is a view showing the details of a range adjusting cam used in that switch.

The end 36*c* of the cam follower 36 bears against the outer cam track 42*a* formed on a range cam 42. Cam 42 as best shown in FIGS. 3 and 6 has its cam track 42*a* formed to move the end of the stem portion 36*b* of cam follower 36. With the mounting arms 30*g* and 30*h* of reed member 30 secured as aforedescribed they are placed in tension to cause the cam follower 36 to be biased toward the cam 42 so that the stem end 36*c* is continuously in engagement with the track 42*a.* Track 42*a* is gradually inclined upwardly in one direction, and when cam 42 is appropriately rotated causes the stem 36*b* of cam follower 36 and the portion 30*a* of member 30 to move downwardly as viewed in FIG. 3. If the cam 42 is oppositely rotated cam follower 36 and the portion 30*a* will move upwardly due to the bias imparted by the stressed mounting legs 30*g* and 30*h.*

Cam 42 is provided with an integrally formed shaft 42*b* which extends through a bearing opening in the base 10. A coupling member 16 is secured to the shaft 42*b* exteriorally of base 10 and is adapted to receive a range adjusting knob as will hereinafter be more fully explained.

An actuator lever 46 preferably formed of a molded insulating material has a main base portion 46*a* which as viewed in FIG. 3 is of a shallow V shape in longitudinal cross section. At its apex 46*b* the portion 46a bears against the outer surface of diaphragm 12*a* of power element 12. An integral upstanding boss 46*c* is provided on lever 46 and the end thereof bears against a range calibration screw 48 which is threaded into base 10. The left-hand end of lever 46 merges with a rectangular cross section boss 46*d* which at the end thereof is provided with a cylindrical pin portion 46*e.* The pin 46*e* extends through a clearance opening 30*j* in member 30 and the shoulder 46*f* between the upper end of boss 46*d* and pin 46*c* bears against the actuator arm 30*e.* The end of pin 46*e* is adapted to be engaged by the inner cam portion 42*c* of cam 42.

In one extreme rotary position of cam 42 the cam portion 42*c* effectively moves pin 46*e* of lever 46 to a position where the shoulder 46*f* is held disengaged from the actuator level portion 30*e* of member 30. The flipper arms 30*c* and 30*d* are then in tension and biased upward and actuator arm 30*e* is in compression and biased downwardly as viewed in FIG. 3. Consequently contact arm snaps upwardly to its stable position wherein it engages against the inclined surface of an arc gap cam 50.

Cam 50 is secured on a shaft 52 which has an exterior kerf or slot for rotation by a screw driver or the like. By rotation of shaft 52 the open gap between contact 32 of member 30 and stationary contact 24 can be adjusted, and this determines the desired differential between the contacts open ("off"), and closed ("on") positions.

A rotary knob coupling member 16 is secured exteriorly of the base 10 on the shaft 42*b* of cam 42. As shown in FIGS. 2 and 8, member 16 is provided with a base portion 16*a,* and integral upwardly wing portions 16*b* and 16*c* of different widths which incline towards an integral cylindrical central portion 16*d.* The base portion 16a is convexedly curved so that short downward extensions of the wing portion 16*b* and 16*c* bear against the upper surface of base 10 to cause the wings to incline towards the central portion 16*d* as shown in FIG. 8. With a suitable design of control adjusting knob, for example the knob 17 as shown in FIG. 2, the wings 16*b* and 16*c* provide a friction grip within complementally formed recesses in the inner hub 17*a* of the knob to hold it in place without need for any additional fastner.

Operation of the thermostat will now be described with reference to FIG. 3. In the positions of the parts shown the switch is in the open or "off" position. The inner cam projection 42*c* is engaged with the end of the pin 46*e* of lever 46 and holds the latter in a position wherein the shoulder 46*f* is out of engagement with portion 30*e* of member 30. Consequently member 30 under the bias of the spring 34 assumes its stable overcenter position in which the upper surface of the bright of the portion 30*b* engages with the cam 50 thereby holding the contact 32 separated from stationary contact 24.

Now let it be assumed that knob 17 is rotated clockwise as viewed in FIGS. 1 and 2. Within a few degrees of rotary movement the pin 46*e* disengages from the cam projection 42*c,* and the shoulder 46*f* of lever can then engage with the portion 30*e* upon upward pivotal movement by upward movement of the diaphragm 12*a* of the power element.

As the know 17 is rotated further in the clockwise direction the end of the stem 36*b* engaging with the cam track 42*a* is moved downwardly. This results in corresponding downward movement of the portion 36*b* of the cam follower 36 and the portion 30*a,* and 30*e* of member 30. Let it be assumed that knob 17 is rotated to an intermediate point beyond its "off" position. As the power element or the element 12*c* are subjected to increasing temperatures there will be an increase in internal vapor pressure which causes diaphragm 12*a* to move upwardly. Consequently lever 46 is caused to pivot clockwise with the end of the portion 46*c* pivoting on the end of range calibration screw 48.

As upward pivotal movement of lever 46 continues its shoulder 46*f* bearing against the portion 30*e* moves the latter upwardly and compresses the spring member 34. Finally when the portion 30*e* and the end 34*b* of the spring move over center, the flipper legs 30*c* and 30*d* and the end 30*a* move downwardly with snap action and the portion 30*f* and 30*b* are driven downwardly to effect engagement of contact 32 with contact 24 to complete the electrical circuit between terminals 18 and 20.

It will be apparent that for every increase in change of rotary position of knob 17 in the clockwise direction the foregoing snap action operation will occur at a correspondingly decreased temperature. This is due to the fact that the amount of movement of lever 46 in the pivotal upward direction required to effect such snap action operation is correspondingly decreased. The adjustment of the range calibrating screw provides a means for calibrating the operator to occur at a predetermined temperature at some given rotary position of the cam 42.

As will be apparent under decreasing temperatures lever 46 will pivot counter clockwise and downwardly, and ultimately will permit member 30 and spring 34 to move with snap action back to their respective stable positions depicted in FIG. 3.

I claim:

1. In combination in a thermostatic control device:

a molded insulating base;

a pair of spaced apart electrical terminals secured on said base and extending outwardly thereof, one of said terminals having an electric contact mounted thereon within said base, a one piece flexible metal member comprising a base portion, mounting portions extending perpendicularly of said base portion at opposite ends of the latter and then oppositely of said mounting portions being anchored near the ends thereof with one in electrical contact with the other of said terminals, a generally U-shaped portion having its legs connected to said base portion between said mounting portions and having an electrical contact mounted on its bight to align with said contact on said one of said terminals, an operator portion extending from said base portion partway towards said bight, an extension on said bight aligned with and extending towards the end of said operator portion, and flipper leg portions projecting from said base portion on opposite sides of said operator portion and having ends that hook back towards said base portions, a spring member formed of flat spring metal and mounted between said operator portion and the hooked ends of said flipper legs so that it assumes generally a C-shape in longitudinal cross section to compressively load said operator portion and tensionally load said flipper legs so that said flexible metal member normally assumes a stable position in which its contact is disengaged from the first mentioned contact, a thermal power element secured to said base and having a diaphragm which moves toward said operator portion of said flexible member in accordance with increases in pressure in its diaphragm chamber, and a one piece lever mounted for pivotal movement in said base and having a portion in engagement with said diaphragm and another portion engagable with said operator portion of said flexible member to move the latter and effect snap-action movement of said spring member to effect closure of said electrical contacts upon a given degree of movement by said diaphragm.

2. The combination according to claim 1 together with:

a range adjusting member mounted for rotary movement on said base and having an inclined cam track formed thereon, and a cam follower member having a portion in which said base portion of said flexible member is secured and another portion which engages with said cam track to afford positioning of said base and actuator portion of said flexible member at various distances from said diaphragm in accordance with the rotary position of said range adjusting member.

3. The combination according to claim 2 wherein said range adjusting member has a cam projection which in given positions of such member engages with said lever to hold the same out of engagement from said operator portion of said flexible member to allow the latter to assume its said normal contact disengaged position.

4. The combination according to claim 2 wherein said lever is generally U-shaped in longitudinal cross section and the bight portion bears against said diaphragm and a shoulder formed adjacent the end of one leg engages with said actuator position, and wherein the end of the other leg of said lever engages with the end of a calibration screw threaded in said base.

5. The combination according to claim 4 together with a contact spacing adjusting member which is mounted for rotary adjustment in said base and has an inclined spiral surface which in said normal position of said flexible member engages with the latter to provide a desired normal position spacing between the contacts carried by said bight and said one of said terminals.

* * * * *